US008607606B2

(12) United States Patent
Boguslavsky et al.

(10) Patent No.: US 8,607,606 B2
(45) Date of Patent: Dec. 17, 2013

(54) METHOD FOR PRODUCING THE ROUND EDGE OF A PART, DEVICE FOR CARRYING OUT SAID METHOD AND A STRIKER USED THEREIN

(76) Inventors: Boris Zelmanovich Boguslavsky, Kazan (RU); Boris Semenovich Litvak, Moscow (RU)

( * ) Notice: Subject to any disclaimer, the term of this patent is extended or adjusted under 35 U.S.C. 154(b) by 367 days.

(21) Appl. No.: 12/936,073

(22) PCT Filed: Mar. 30, 2009

(86) PCT No.: PCT/RU2009/000150

§ 371 (c)(1),
(2), (4) Date: Oct. 29, 2010

(87) PCT Pub. No.: WO2009/123505

PCT Pub. Date: Oct. 8, 2009

(65) Prior Publication Data

US 2011/0061433 A1 Mar. 17, 2011

(30) Foreign Application Priority Data

Apr. 3, 2008 (RU) ..... 2008112710

(51) Int. Cl.
*B21J 7/16* (2006.01)
*B21J 5/06* (2006.01)
*B21J 5/00* (2006.01)

(52) U.S. Cl.
USPC ..... 72/57; 72/710; 72/76

(58) Field of Classification Search
USPC ..... 72/710, 56, 57, 430, 73, 74, 76; 148/558
See application file for complete search history.

(56) References Cited

U.S. PATENT DOCUMENTS

| | | | | |
|---|---|---|---|---|
| 4,152,914 | A * | 5/1979 | Tyavlovsky et al. | 72/56 |
| 4,639,991 | A | 2/1987 | Sharon | |
| 5,249,450 | A * | 10/1993 | Wood et al. | 72/710 |
| 2009/0163877 | A1 * | 6/2009 | Christoffersen et al. | 604/240 |

FOREIGN PATENT DOCUMENTS

| | | | |
|---|---|---|---|
| RU | 2 286 227 | C2 | 10/2006 |
| SU | 1720779 | A1 | 3/1992 |
| WO | WO 2006/077072 | * | 7/2006 |

OTHER PUBLICATIONS

International Search Report for International Application No. PCT/RU2009/000150, mailed Jul. 9, 2009, one page.

* cited by examiner

*Primary Examiner* — Dana Ross
*Assistant Examiner* — Mohammad I Yusuf
(74) *Attorney, Agent, or Firm* — Nath, Goldberg & Meyer; Jerald L. Meyer; Scott C. Langford

(57) ABSTRACT

The inventive method involves deforming the extremities of a plate, which has a rectangular edge and is disposed between the working surface of strikers, by ultrasonic forging with the aid of the strikers, simultaneously moving the plate in a transverse direction with respect to the longitudinal axes of the strikers and turning the strikers. Each striker is provided with a groove with a curvilinear generatrix which is made on the surface thereof with a variable radius R. The width of the plate is reduced by a value $\Delta=R(1-\pi/4)$, wherein R is the variable radius value at a point where the ultrasonic forging of the plate is carried out. The circumferential speed $V^{circ.S}$ of the striker rotation is chosen, during the plate displacement, as to correspond to the above-mentioned relationship. In the device, the circumferential speed of the striker rotation is synchronized with the plate displacement velocity. The groove of the striker is designed with the variable radius R.

2 Claims, 4 Drawing Sheets

METHOD FOR PRODUCING THE ROUND EDGE OF A PART, DEVICE FOR CARRYING OUT SAID METHOD AND A STRIKER USED THEREIN

FIELD OF THE INVENTION

This invention relates to mechanical engineering, namely to metal treatment by ultrasonic forging, and may be used for producing parts having improved performance and for forming round edges of variable thickness.

BACKGROUND ART

Rolling methods involving roll ultrasonic vibrations are known, which consist in that during common rolling of a plate ultrasonic vibrations are generated in rolls with the use of magnetostrictors attached to ends of the rolls (see: Severenko, V. P., Klubovich, V. V., Stepanenko, A. V. "Rolling and Drawing with Ultrasound", Nauka I Tekhnika Publishing House, Minsk, 1970, p. 136-181).

When rolled with ultrasound, a treated material is subjected to vibrations of a variable amplitude, which is associated with a parallel arrangement of rolls relative to a plate and a significant length of a deformation area. And ultrasonic vibrations during rolling are only an auxiliary means for reducing friction forces and somewhat increasing plasticity of a treated material. During forging with the use of ultrasound vibrations are directed along the longitudinal axis of strikers, i.e., orthogonally to a plate. During ultrasonic forging a plate edge is directly deformed mainly due to an acoustic energy. Thus, processes occurring during deformation of a material treated by forging with ultrasound and by rolling with ultrasound are completely different, and, in contrast to forging, friction forces occurring during rolling with ultrasound are directed exactly along the longitudinal axis of a plate.

A method of producing a cutting tool blade is known, which comprises: forming a plate, deforming, by ultrasonic forging, a plate end arranged between the conical surfaces of strikers, while simultaneously moving the plate laterally relative to the strikers' axes for forming a wedge blade on the plate (SU No. 1720779).

According to the known method, a blank, while being deformed, is moved laterally to the applied static dam force, and a gap value between the strikers is maintained for the whole deformation cycle at the level of a double amplitude of ultrasonic vibrations.

An advantage of this method is the possibility of producing parts having cutting edge thickness from 1 to 3 microns and with a minimum burr or without it.

Disadvantages of the method are: complexity of the ultrasonic forging process due to the necessity of selecting a value of the static end force in the conditions of variable plate sizes and deviations of the plate movement true trajectory from that pre-set in a mechanism for moving a blank; the problem of maintaining a gap between the strikers during the whole deformation cycle; the necessity of using several lateral passes of a plate between the strikers for producing a cutting edge with a minimum thickness.

The principal disadvantage of the method, which, seemingly, enables to produce high-quality cutting edges having small metal grains and minimum thicknesses, as research works show, is the presence of a hidden defect in the form of a narrow slot-like micro cavity in the symmetry plane of a cutting edge.

In order to remove the said defect, another known technical solution proposes to round a plate edge (RU No. 2211742).

A disadvantage of the said method is the necessity of carrying out additional operations for producing a blank itself, which is provided with preliminary bevels by rolling, grinding, pressing in a die, or by preliminary ultrasonic forging of a plate end.

The principal disadvantage of the said method, which is inherent in the above ultrasonic forging methods also, is a small working surface area of strikers involved into deformation, that results in quick wear of the striker working surfaces and the necessity of stopping the whole process, repairing the tools and re-adjust the equipment.

A method of ultrasonic treatment of a part edge is known, which comprises ultrasonic forging deformation of an edge of a plate having a rectangular edge arranged between the wedge surfaces of strikers, wherein the plate is simultaneously moved laterally in relation to the longitudinal axes of the strikers, the latter being rotated about their longitudinal axes, and each of the strikers is provided with a hollow (groove) having a curvilinear generatrix on its wedge surface, the shape of the hollow corresponding to a pre-set profile of the part edge on the plate top and bottom (RU No. 2286227).

This method is used for making a cutting tool blade with a very sharp edge, in particular with a curvilinear generatrix of the groove, which generatrix can be described by the quadratic polynomial $Y=\pm AX^2\pm BX\pm C$, where Y is the direction along the striker lateral axis, and X is the direction along the striker longitudinal axis.

The method enables to improve quality of a cutting edge, while maintaining its pre-set thickness, reduce the treatment time, improve roughness of the cutting edge surface, reduce the number of blank treatment operations in the process of ultrasonic forging, increase the service life of the tools used, make the control of the process and its automation better.

A disadvantage of this method is that it cannot be used for producing parts from plates having different thicknesses, e.g., when the plate thickness changes along the plate length or width. The method does not provide for making rounded edges having a variable radius, e.g., for parts having a complex shape, such as turbine vanes, etc. For example, at present turbine vanes are produced by precision grinding with the use of templates.

A device for ultrasonic treatment of a part edge is also known, which comprises strikers connected to ultrasonic vibration sources and arranged opposite to each other, and their working surfaces are made conical, the mechanism is made so as to provide movement of a plate with a rectangular edge between the striker working surfaces, laterally relative to their longitudinal axes, and is installed with the possibility of deforming the plate edge, an actuator is made with the possibility of rotating the strikers about their longitudinal axes, a hollow (groove) being made on each striker with a curvilinear generatrix on the striker wedge-like surface and having a shape corresponding to a pre-set profile of the part edge on the plate top and bottom (RU No. 2286227).

The said device is designed for producing cutting tool blades and has both the advantages and the disadvantages of the above method. The known device cannot produce a rounded edge of a blank having different thicknesses and a variable radius.

A striker is also known, which is included into the above device and which has a working surface made wedge-like and intended for deforming a plate edge by ultrasonic forging, a groove being made on the wedge-like working surface, which curvilinear generatrix corresponds in its shape to a pre-set profile of the part edge on the plate top and bottom (RU No. 2286227).

This striker enables to reduce wear of its working surface, improve the quality of the edge of a produced part, increase its service life and decrease a deforming force.

A disadvantage of this tool, i.e., a striker, is the impossibility of using it for rounding an edge of a blank having different thicknesses, e.g., for making a rounded end of a turbine vane without a burr, a buildup of a material or a cavity.

SUMMARY OF THE INVENTION

The present invention is based on the objective of expanding the functionality, improving quality of a part having a rounded edge, improving producability of a rounded edge for shaped parts, reducing labor intensity and improving conditions for automation of the process by reducing the number of passes required for forming a rounded edge.

The technical effect that may be obtained when carrying out the proposed method is quality improvement of a rounded edge, while maintaining its pre-set variable thickness, reduction in the treatment time, improvement of roughness of the rounded edge, reduction in the number of blank treatment operations in the process of ultrasonic forging, making of the control of the process and its automation better.

The technical effect that can be obtained when carrying out the proposed device is quality improvement of a rounded edge together with a reduction in the number of passes required for the production of the part to one, making of the control of the process and its automation better.

The technical effect that can be obtained when carrying out the proposed striker is quality improvement of a rounded edge in produced parts, an increase in the service life of the striker used for producing a rounded edge and a reduction in the deforming force used for producing a rounded end of a part.

In order to achieve the said objective and the said technical effect the method of forming a rounded edge of variable thickness on a plate includes arranging a source plate with a rectangular edge between the striker working surfaces made with at least one groove which generatrix corresponds in its shape to the profile of the plate rounded edge and has a variable radius R, deforming the plate edge by the strikers provided with ultrasonic vibrations, while simultaneously moving the plate laterally in relation to the striker longitudinal axes, the source plate being used which width is less than that of the treated plate by the value $A=R(1-\pi/4)$, where R is the value of a variable radius in the place of ultrasonic forging of the plate by the strikers, and, when the plate is moved laterally, the strikers are turned about their longitudinal axes with the circumferential velocity $V^{Circ\ S}$ which is obtained from the following expression:

$$V^{Circ\ S}=(V^{Lin\ P}\times\alpha\times\pi D^{K})/(360\times L)\text{mm/sec},$$

where:

$V^{Lin\ P}$ is the plate movement velocity in mm/sec, $\alpha$ is the striker turn angle in degrees, $\pi=3.14$, $D^{K}$ is the striker working diameter—its end minimum diameter in millimeters, L is the plate length in millimeters.

In order to achieve the said objective and obtain the said technical effect, in the known device for ultrasonic treatment of a part edge, comprising: the strikers connected to electro-acoustical transducers of ultrasonic vibrations and arranged one opposite to the other, which working surfaces are made wedge-like; the mechanism made so as to move a plate with a rectangular edge between the striker working surfaces laterally in relation to their longitudinal axes and arranged with the possibility of deforming the plate edge; the actuator made with the possibility of turning the strikers about their longitudinal axes, a groove with a curvilinear generatrix being made on each striker, which groove corresponds in its shape to a pre-set profile of the part edge on the plate top and bottom, according to the invention the groove is made with a curvilinear generatrix on each striker with a variable radius R, the plate width is reduced relative to the required one by the value $A=R(1-\pi/4)$, where R is a value of the variable radius at the place of ultrasonic forging of the plate by the strikers, and, when the plate is moved laterally in relation to the striker longitudinal axes, the circumferential velocity $V^{Circ\ S}$ of the turning strikers is synchronized with the velocity $V^{Lin\ P}$ of the plate movement in accordance with the following relation:

$$V^{Circ\ S}=(V^{Lin\ P}\times\alpha\times\pi D^{K})/(360\times L)\text{mm/sec},$$

where:

$\alpha$ is the striker turn angle, in degrees, $\pi=3.14$

D—is the striker working diameter—a minimum diameter of the groove, in millimeters.

In order to achieve the said objective and obtain the said technical effect, in the known striker for ultrasonic treatment of a part edge, which comprises a working surface intended for deforming the part edge by ultrasonic forging and provided with a groove with a curvilinear generatrix, according to the invention the groove with the curvilinear generatrix is made with a variable radius R.

Additional embodiments of the striker are possible, wherein it is expedient that:

- the profile of a hollow with a curvilinear generatrix is made less than a half of the circumference;
- two grooves are made on a striker, which are symmetrical to each other, and the maximum striker turn angle $\alpha=180°$;
- one groove is made on a striker, the maximum striker turn angle $\alpha=270°$.

The described advantages as well as specific features of this invention will be further explained on its best embodiments with reference to the accompanying drawings.

BRIEF LIST OF THE DRAWINGS

FIG. 1 schematically shows a device for carrying out the proposed method, where the arrows show the direction of ultrasonic vibrations, the application of a static load and the rotation of ultrasonic vibration transducers with strikers attached thereto;

FIG. 2 schematically shows the process of producing a rounded edge, the beginning;

FIG. 3 same as FIG. 2, the middle of the process;

FIG. 4 same as FIG. 2, the end of the process;

FIG. 5 shows the cross-section A-A of FIG. 2;

FIG. 6 shows the cross-section A-A of FIG. 3;

FIG. 7 shows the cross-section A-A of FIG. 4;

FIG. 8 shows the cross-section A-A of FIG. 1, the arrows show the plate movement directions, the striker turning directions, and the vane deformation area E;

FIG. 9 shows the cross-section C-C of FIG. 8, where the plate edge is positioned relative to the strikers in an ideal case;

FIG. 10 schematically shows a change in the plate width during ultrasonic forging and rounding the plate edge at a variable radius R;

FIG. 11 schematically shows a decrease in the plate blank width for a variable radius R;

FIG. 12 shows the design of a striker with two symmetrical grooves (longitudinal section);

FIG. 13 same as FIG. 12, a bottom view on FIG. 12 (an arrangement of the striker working surfaces is shown schematically);

FIG. 14 shows the design of a striker with one groove, an arrangement of the striker working surface is shown schematically;

FIG. 15 shows the cross-section D-D of FIG. 14.

BRIEF DESCRIPTION OF THE DRAWINGS

Since the method for producing a rounded part edge is implemented in the proposed device for ultrasonic treatment of a part edge, the design of the said device will be described first (FIG. 1).

Figure 1:
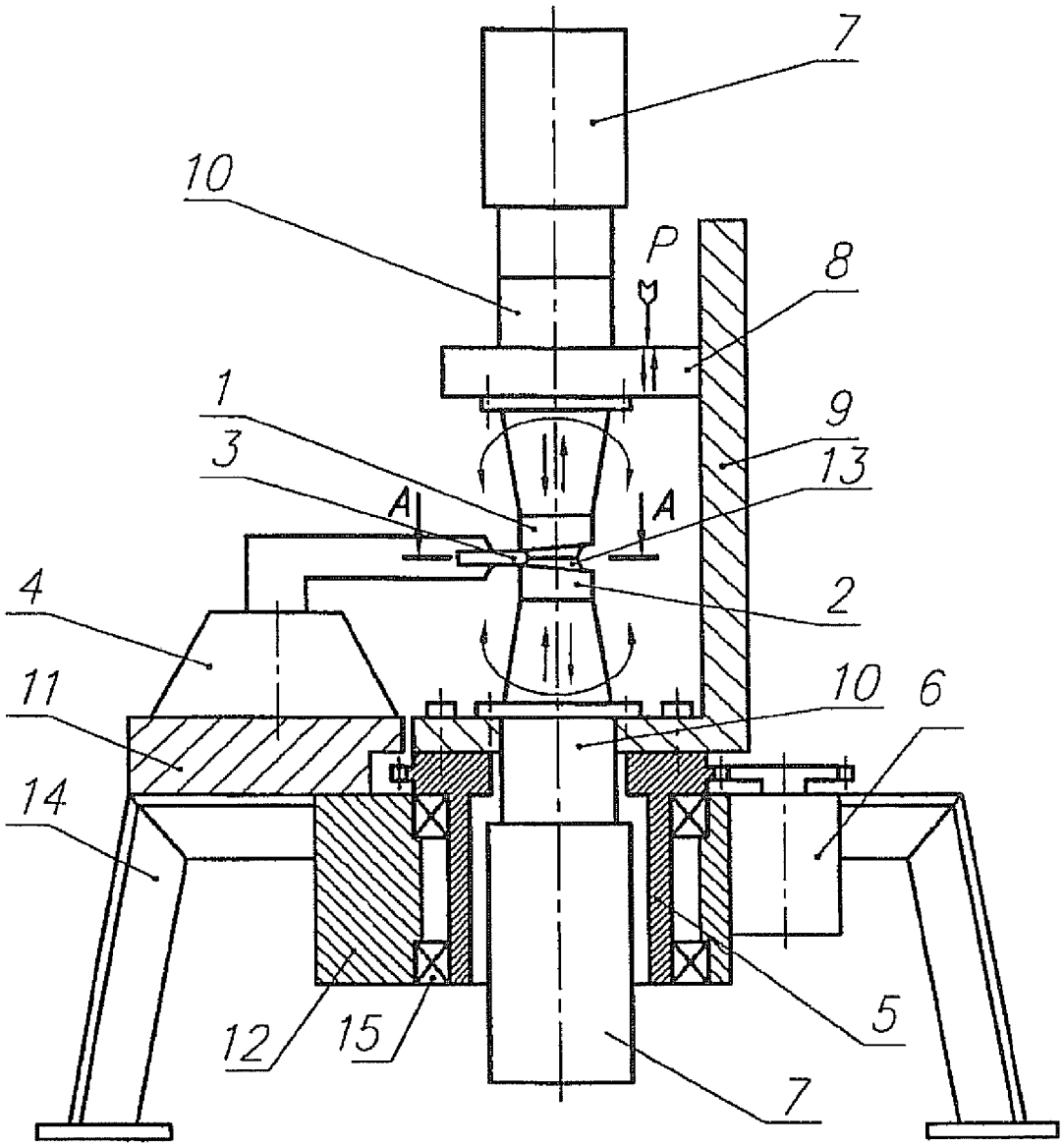
FIG. 1 shows: an upper striker 1, a lower striker 2, a plate 3, a mechanism 4 for moving the plate 3, a bush 5 with a gear, an electric motor 6 with a gear engaged with the gear of the bush 5, transducers 7 of electric pulses into ultrasonic vibrations, an upper cantilever 8 with a hole for rigidly fixing an upper waveguide, a bracket 9, waveguides 10, a table 11, a housing 12 of the bearing unit, a bearing 15, a frame 14.

For this shown design the bush 5 with the gear, the electric motor 6 with the gear, the cantilever 8, the bracket 9, the housing 12 of the bearing unit, the bearing 15, all being linked cinematically, as shown in FIG. 1, form an actuator made with the possibility of turning the strikers 1 and 2 about their longitudinal axes. The transducers 7 of electric pulses into ultrasonic vibrations and the waveguides 10 are the sources of ultrasonic vibrations for the strikers 1 and 2. The mechanism 4 for moving the plate 3 may be made on the basis of an electronic manipulator.

It will be appreciated by those skilled in the art that the design shown in FIG. 1 is not a single possible design. Other devices may be used, which provide for movement of the plate 3, turning the strikers 1 and 2 and supply ultrasonic vibrations to them, e.g., as described in RF Patent No. 2286227. However, the device shown in FIG. 1 is the simplest.

Thus, the device for ultrasonic treatment of a part edge (FIG. 1) generally comprises the strikers 1 and 2 connected to the electroacoustic transducers of ultrasonic vibrations, arranged one opposite to the other, and having the grooves 13 on their working surfaces. The mechanism 4 is made so as to provide for movement of the plate 3 with the rectangular edge between the working surfaces of the strikers 1 and 2 laterally in relation to their longitudinal axes and is spatially arranged with the possibility of deforming the edge of the plate 3. The actuator is made with the possibility of turning the strikers 1 and 2 about their longitudinal axes. Each of the strikers 1 and 2 is provided with the groove 13 having a curvilinear generatrix on its end, which groove corresponds in its shape to a pre-set profile of the part edge on the plate 3 top and bottom.

The groove 13 is made with a curvilinear generatrix on each of the strikers 1 and 2 with a variable radius R. The width of the plate 3 is decreased in comparison to the pre-set one by the value $\Delta=R(1-\pi/4)$, where R is the value of the variable radius at the place of ultrasonic forging of the plate 3 by the strikers 1 and 2. When the plate 3 moves in a lateral direction relative to the longitudinal axes of the strikers 1 and 2, the circumferential velocity $V^{Circ\ S}$ of the turning strikers 1 and 2 is synchronized with the velocity $V^{Lin\ P}$ of the moving plate 3 in accordance with the following relation:

$$V^{Circ\ S}=(V^{Lin\ P}\times\alpha\times\pi D^{K})/(360\times L)\text{mm/sec},$$

where:

$\alpha$ is a turn angle of the strikers 1 and 2, in degrees, $\pi=3.14$, $D^{K}$ is the working diameter of the strikers 1 and 2, i.e., the minimum diameter of the groove in millimeters.

The ultrasonic forging of the edge of the plate 3 (FIG. 1) is carried out when it is moved by the mechanism 4 between the strikers 1 and 2 that vibrate ultrasonically at a frequency in the range from 20 kHz to 22 kHz. In addition to ultrasonic vibrations the strikers 1 and 2, which are rigidly fixed on the waveguides 10, are synchronously turned by the electric motor 6.

The device (FIG. 1) comprises two ultrasonic units (the transducer 7 and the waveguide 10 with the striker) on the bracket 9 and the cantilever 8, the upper one being able to move up and down on the bracket 9 and being subjected to the static force P, and the lower one is rigidly fixed.

The strikers 1 and 2 have the grooves 13 of a variable section and are arranged coaxially and in a mirror-like way relative to each other.

The bracket 9 is attached to the bush 5 in such a way that the turn axes of the waveguides 10 and the strikers 1 and 2 are coaxial with the longitudinal axis of the bush 5.

The bracket 9 may be turned jointly with the waveguides 10 and the strikers 1 and 2 about their longitudinal axes by the electric motor 6 with the gear and the gear of the bush 5.

The bush 5 with the bearings 15 is arranged in the housing of the bearing unit 12 being the base of the forging device.

The table 11 with the mechanism 4, i.e., an electronic manipulator, is attached to the housing 12.

FIGS. 1, 2-7 schematically show treatment of the edge of the plate 3 at a variable radius, i.e., the radius varies in different places of the grooves of the strikers 1 and 2.

For example, the edge of the plate 3 may be smoothly increased or decreased along its length L (as shown in FIGS. 2-7), or may be changed depending on pre-set technical parameters of a particular part, e.g., a turbine vane with variable thickness. And in such a case the device functions successfully, since the plate width may be easily decreased from a pre-set one by the value $\Delta=R\times(1-\pi4)$, where R is the value of a variable radius at the place of ultrasonic forging of the plate 3 by the strikers 1 and 2 at a certain time, and when the plate 3 is moved in the lateral direction relative to the longitudinal axes of the strikers 1 and 2, the circumferential velocity $V^{Circ\ S}$ of the turning strikers 1 and 2 is synchronized with the plate movement velocity $V^{Lin\ P}$ in accordance with the following relation:

$$V^{Circ\ S}=(V^{Lin\ P}\times\alpha\times\pi D^{K})/(360\times L)\text{mm/sec},$$

where:

$\alpha$ is the turn angle of the striker 1 and, respectively, the striker 2, in degrees, $\pi=3.14$ $D^{K}$ is the working diameter of the striker—the minimum diameter of the groove 13, in millimeters.

In order to synchronize $V^{Circ\ S}$ and $V^{Lin\ P}$, the mechanism 4 and the electric motor 6 may be made adjustable.

Example 1

Figure 2:
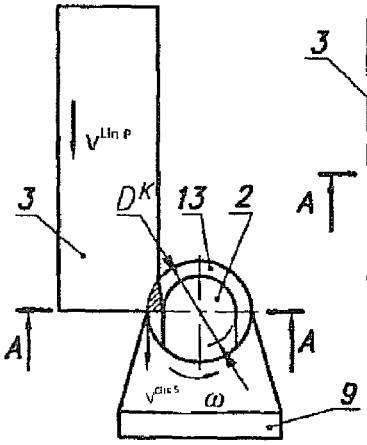
Figure 3:
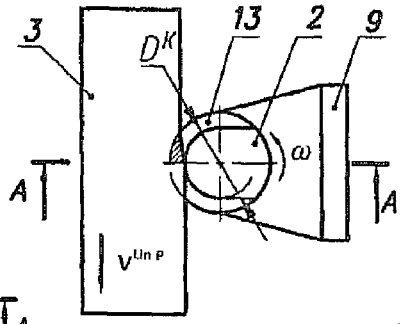
Figure 4:
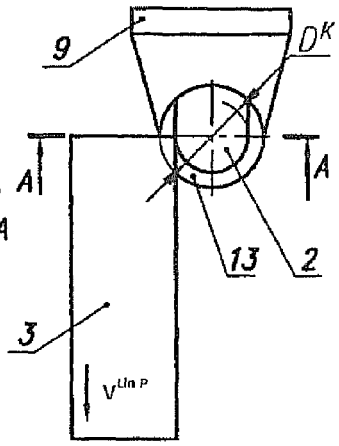
Figure 5:
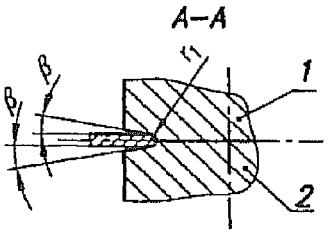
Figure 6:
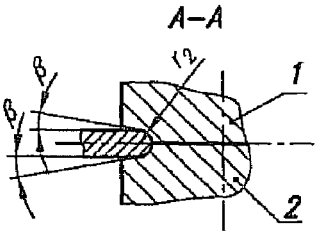
Figure 7:
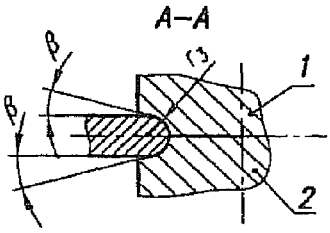

FIGS. 2, 5 show the plate 3 entering the forging area with a variable radius R, where $R_{min}=r1=0.3$ mm.

The circumferential velocity $V^{Circ\ S}$ of the strikers 1 and 2 is significantly less than the plate linear velocity $V^{Lin\ P}$. And when the plate 3 is treated by ultrasonic forging to the middle of its length L (FIGS. 3, 6), the striker 2 will be turned by 90°, and the groove radius will become intermediate $R_{int}=r2=0.65$ MM.

In the end of the treatment of the plate 3 the strikers 1 and 2 are turned by 180° from their initial positions (FIGS. 4, 7), and the edge will be treated at the maximum variable radius $R_{max}$=r3=1.0 mm.

Figure 8:
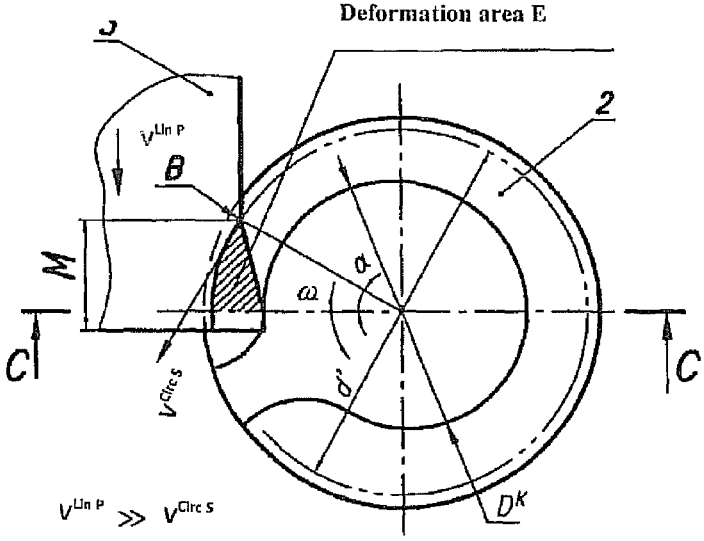

FIG. 8 shows the cross-section A-A of FIG. 1 (enlarged view), where the arrows show the movement direction of the plate at the velocity $V^{Lin\ P}$, the turning direction of the strikers ω, and the plate deformation area E.

When the plate 3 with a rectangular edge is subjected to ultrasonic forging, it enters the groove 13 between the strikers 1 and 2 at the point B on the diameter d', where the thickness of the plate 3 corresponds to the grooves 13. Then the plate edge is deformed by the strikers to the distance M up to the strikers' axes. The value M depends on the diameter of the strikers, the thickness of the edge of the plate 3 and the shape of the groove.

Figure 9:
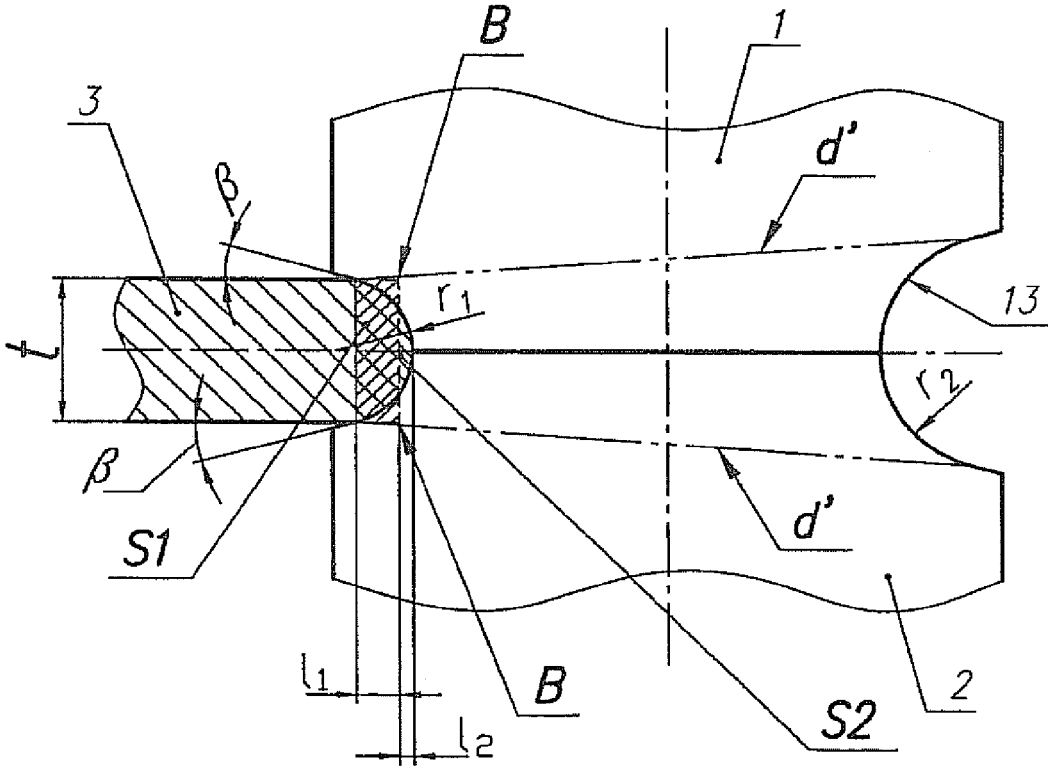

FIG. 9 shows the cross-section C-C of FIG. 8, where the position of the plate edge relative to the strikers 1 and 2 is shown for an ideal case: the surface area of the edge of the plate 3 $S_1=t\times l_1$ before deformation is equal to the surface area $S_2\sim\pi t^2/8$ after deformation.

The symbols used in FIG. 9:

t—thickness of the plate 3;

β—points where the edge of the plate 3 enters the deformation area;

d'—diameter of the groove 13, where the thickness of the edge of the plate 3 is equal to the height of the groove 13;

$l_1$—deformation value of the edge of the plate 13;

$l_2$=Δ—width increase of the plate 3 when deformed.

Figure 10:
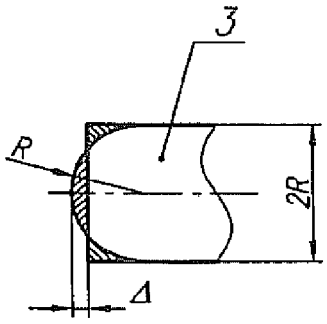

During classical ultrasonic forging of the rectangular edge of the plate 3 metal is displaced into the grooves of the strikers 1 and 2, and the plate width is increased by the value Δ (FIG. 10). The value A is directly proportional to the ultrasonic forging radius A=R(1−π/4). Therefore, a blank of the plate 3 should be less than the final pre-set parameters by the value A.

Example 2

Figure 11:
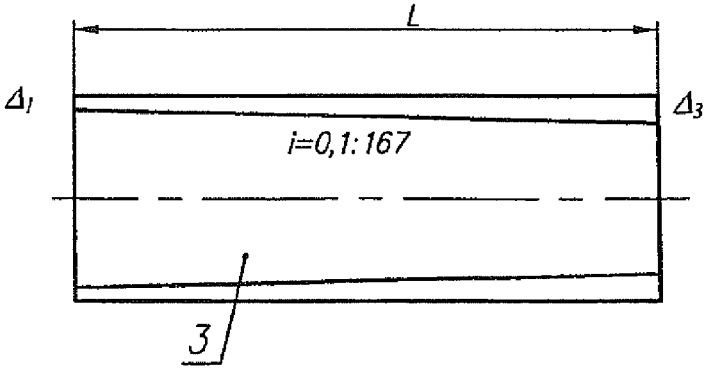

For $R_{min}$=r1=0.3 mm Δ1=0.065, and for $R_{max}$=r3=1 mm Δ3=0.215. For such a blank of the plate 3 the general slope is equal to i=(1−π/4) (R−r)/L. If the length of the plate 3 L=250 mm, then i=01:167 (FIG. 11). Furthermore, due to the selection A=R(1−π/4) the deformation force required for obtaining a rounded end of the part is decreased.

In a general case the edge of the plate 3 may be curvilinear, rather than rectilinear, as shown in FIGS. 2, 3, 4, 8. In such a case the mechanism 4, e.g., an electronic manipulator, moves the plate 3 not only in the lateral direction relative to the longitudinal axes of the strikers 1 and 2, but also ensures that a tangent line to the curvilinear surface of the plate 3 is positioned orthogonally to the longitudinal axes of the strikers 1 and 2. For this case the relation A=R(1−π/4) is maintained both for the curvilinear surface of the plate 3 and for the plate 3 itself which thickness is changed along its length.

Thus, the proposed method of ultrasonic treatment of a part edge is characterized by that:

the edge of the plate 3 with a rectangular edge, which is arranged between the wedge-like surfaces of the strikers 1 and 2, is deformed by ultrasonic forging with the use of the strikers 1 and 2;

the plate is simultaneous moved in the lateral direction relative to the longitudinal axes of the strikers 1 and 2, when the strikers 1 and 2 are turned about their longitudinal axes, the groove 13 with a curvilinear generatrix on its surface being made on each of the strikers 1 and 2, which corresponds in its shape to a pre-set profile of the part edge on the top and the bottom of the plate 3;

the groove is made with a curvilinear generatrix on each of the strikers 1 and 2 with a variable radius R;

the width of the plate 3 is decreased by the value A=R(1−π/4), where R is the value of the variable radius at the place of ultrasonic forging of the plate 3 by the strikers 1 and 2;

when the plate 3 is moved laterally in relation to the longitudinal axes of the strikers 1 and 2, the circumferential velocity $V^{Circ\ S}$ of turning the strikers 1 and 2 is selected in accordance with the following relation:

$$V^{Circ\ S}=(V^{Lin\ P}\times\alpha\times\pi D^K)/(360\times L)\text{mm/sec},$$

where:

$V^{Lin\ P}$ is plate movement velocity, in mm/sec,

α is the turn angle of the striker 1 or the striker 2, in degrees, π=3.14

$D^K$ is the working diameter of the striker—the minimum diameter of its wedge—like surface, in millimeters, L is the plate length, in millimeters.

Due to selecting a circumferential velocity $V^{Circ\ S}$ of turning the strikers 1 and 2 in accordance with the said relation and the groove 13 with a variable radius R, it becomes possible to produce a high-quality rounded edge and reduce the number of passes required for the production of the part down to one, improve the control of the process and its automation.

The striker 1 or 2 (FIGS. 12-15) for ultrasonic treatment of a part edge comprises a working surface provided with a groove 13 and intended for deforming the edge of the plate 3 by ultrasonic forging. The groove 13 is made on the working surface, which curvilinear generatrix corresponds in its shape to a pre-set profile of the part edge on the top and the bottom of the plate 3. The groove 13 with a curvilinear generatrix is made with a variable radius R on the striker 1 or 2.

The profile of the groove 13 with a curvilinear generatrix may be made on less than a half of the circumference (FIG. 9).

The groove 13 on the working surface of the strikers 1 or 2 may be made in the form of two grooves (FIGS. 12, 13) symmetrical to each other and with the maximum turn angle of the striker α=180°.

The groove 13 on the working surface of the strikers 1 or 2 may be made in the form of one groove (FIGS. 14, 15) with the maximum turn angle of the striker α=270°.

Example 3

Making the strikers 1 and 2.

Let's set:

$R_{min}$=r1=0.3 mm; $R_{max}$=r3=1.0 mm; the length of the plate 3 for a vane, L=250 mm; the striker outer diameter $D^S$=20 mm; the working diameter of the striker 1 or the inner diameter of the groove 13, D=17 mm.

Figure 12:
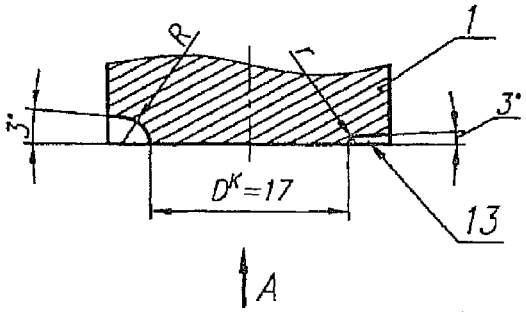
Figure 13:
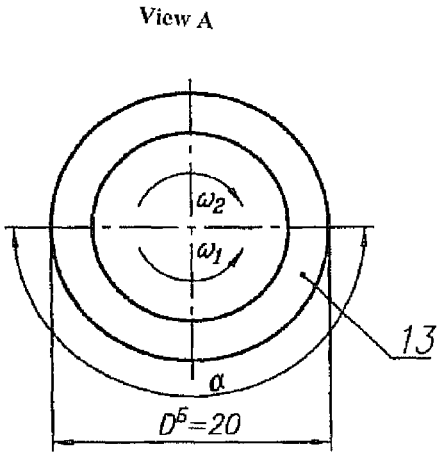
Figure 14:
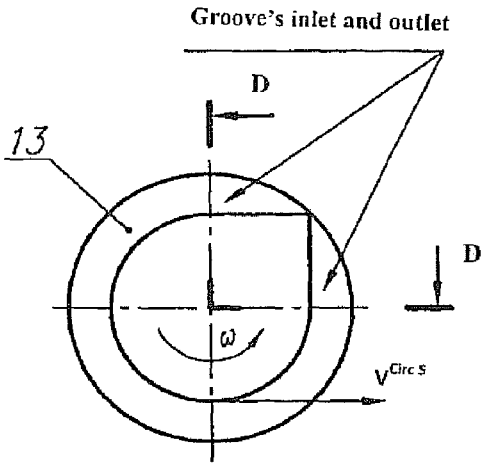
Figure 15:
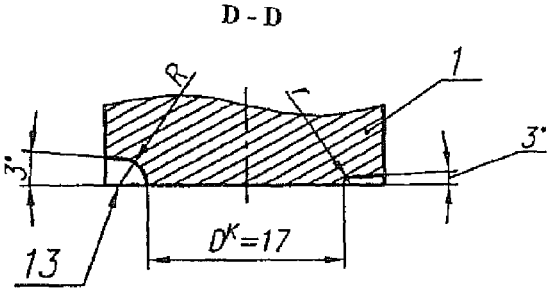

Let the strikers 1 and 2 have two grooves symmetrical to each other (FIGS. 12, 13).

The maximum turn of the strikers in the process of forging the edge of the plate 3, α=180°.

The depth of the groove 13 in the striker body is 1.5 mm.

The inner diameter of the groove 13, $D^K$=17 mm,

The length of the groove 13, $C^K$=53.4 mm. For the two grooves α=180°, therefore, the working length of the groove, $C^{K'}=C^K/2$=26.7 MM.

For the time of turning the strikers 1 and 2 by the angle of 180° the plate will be moved to the length L=250 mm.

Let's set the linear velocity $V^{Lin\ P}$ of the plate, which for high-quality ultrasonic forging, on the basis of experiments, is app.=5 mm/sec.

The ratio of the groove length on ½ of the circumference $C^K$ and the length L of the plate 3 is equal to the relation of $V^{Circ\ S}$ К линейной скорости $V^{Lin\ P}$.

26.7 mm/250 mm=0.107=$V^{Circ\ S}/V^{Lin\ P}$.

Hence, $V^{Circ\ S}$=0.53 mm/sec, speed $n^S$=0.099 rev/sec.

Let the strikers 1 and 2 have one groove with the maximum striker turn angle α=270° (FIGS. 14, 15), i.e., the strikers 1 and 2 in the process of forging the plate edge are turned by the angle α=270°.

The groove depth in the bodies of the strikers 1 and 2 is 1.5 mm (Δ=1.5).

The inner diameter of the groove, $D^K$=17 mm. Then:

$$C^K=(3\pi D^K)/4=40\text{ mm},$$

$$L=250\text{ mm},$$

$$C^K/L=40/250=0.16=V^{Circ\ S}/V^{Lin\ P}.$$

Let's assume that the forging speed is:

$$V^{Lin\ P}=5\text{ mm/sec, then}$$

$$V^{Circ\ S}=5\times0.16=0.8\text{ mm/sec}.$$

On the other side:

the forging time T=250/5=50 sec, the striker will be turned by 270°, $$C^K/T=40/50=0.8\text{ mm/sec}=V^{Circ\ S}$$

Let's convert 40 mm into revolutions—¾ rev at 0.8 mm/sec—$n^S$, hence:

$$n^S=0.8\text{ mm/sec}\times0.75\text{ rev}/40\text{ mm}=0.015\text{ rev/sec}$$

i.e., $$n^S=0.015\text{ rev/sec}=0.9\text{ rev/min}.$$

In general:

$$V^{Circ\ S}=(V^{Lin\ P}\times\alpha\times\pi\times D^K)/(360\times L)[\text{mm/sec}];$$

$$n^S=(V^{Lin\ P}\times\alpha)/(360\times L)[\text{rev/sec}],$$

where:

α—in degrees, $V^{Lin\ P}$—in mm/sec, $D^K$; L—in millimeters.

Thus, we have received the general dependence between the circumferential velocity $V^{Circ\ S}$ of the strikers and the number of striker turns $n^S$ and the plate linear velocity $V^{Lin\ P}$, the length $C^K$ of the groove 13 on the striker, a striker turn angle in degrees, the plate length L and the groove diameter $D^K$, which dependence is necessary for automation of ultrasonic forging.

The strikers 1 and 2 with two grooves are appropriate for producing short vanes, and the striker with one groove—for producing long vanes.

INDUSTRIAL APPLICABILITY

The proposed method of producing a rounded part edge, the device for carrying it out and the striker included in the said device may be best used in the industry for producing various shaped parts, including turbine vanes, with improved performance, high indices of wear resistance and with rounded edges having variable radii.

What is claimed is:

1. A method for producing a rounded edge of variable thickness on a plate by ultrasonic forging, the method comprising:

arranging a source plate having a rectangular edge between working surfaces of strikers, said working surfaces having at least one groove, wherein a generatrix of the at least one groove corresponding in shape to a profile of the plate after treatment of a rounded edge plate, and the generatrix having a variable radius R, and deforming the edge of the plate by the strikers provided with ultrasonic vibrations while simultaneously moving the plate laterally relative to longitudinal axes of the strikers, wherein the plate initially has a width less than that of the plate after treatment by a value Δ=R(1−π/4), where R is the value of the variable radius at the place of ultrasonic forging of the plate, by the strikers, and wherein, when the plate is moved in the lateral direction, the strikers are turned about their longitudinal axis at a circumferential velocity $V^{Circ\ S}$ defined by the following expression:

$$V^{Circ\ S}=(V^{Lin\ P}\times\alpha\times\pi D^K)/(360\times L),\text{ mm/sec},$$

where:

$V^{Lin\ P}$ is a plate movement velocity, in mm/sec,

α is an angle of turning of the striker, in degrees,

π=3.14, $D^K$ is a working diameter of the striker, i.e. the minimum diameter of an end of the striker, in millimeters, L is a plate length, in millimeters.

2. A device for ultrasonic treatment of an edge of a plate, the device comprising:

strikers connected with electroacoustic transducers of ultrasonic vibrations, said strikers arranged one opposite the other, wherein working surfaces of the strikers are provided with grooves with curvilinear generatrices, a mechanism providing movement of the plate initially having a rectangular edge between the working surfaces laterally relative to longitudinal axes of the strikers, said mechanism provided to deforming the edge of the plate;

an actuator provided to turn the strikers about their longitudinal axes, wherein each of the strikers being provided with a groove with a curvilinear generatrix on a surface of the striker, said groove corresponding in shape to a profile of the edge of the plate after treatment on a top and a bottom of the plate;

characterized in that the groove is made with a curvilinear generatrix on each of the strikers, said generatrix having a variable radius R, wherein a width of the plate to be treated is decreased relative to a width of the plate after treatment by a value Δ=R(1−π/4), where R is the value of the variable radius at the place of ultrasonic forging of the plate by the strikers, and when the plate is moved in the lateral direction relative to the longitudinal axes of the strikers, a circumferential velocity $V^{Circ\ S}$ of turning of the strikers is synchronized with a velocity $V^{Lin\ P}$ of movement of the plate in accordance with the following expression:

$$V^{Circ\ S}=(V^{Lin\ P}\times\alpha\times\pi D^K)/(360\times L),\text{mm/sec},$$

where:

α is an angle of turning of the striker, in degrees,

π=3.14, $D^K$ is a working diameter of the striker, i.e. a minimum diameter of the groove, in millimeters.

* * * * *